United States Patent [19]

Klie

[11] 4,195,553

[45] Apr. 1, 1980

[54] FLUID-DISPLACEMENT RADIAL PISTON MACHINE

[75] Inventor: Jurgen Klie, Sprockhövel, Fed. Rep. of Germany

[73] Assignee: D. Duesterloh GmbH, Sprockhoevel, Fed. Rep. of Germany

[21] Appl. No.: 906,646

[22] Filed: May 16, 1978

[51] Int. Cl.[2] ..... F01B 1/06; F04B 1/28

[52] U.S. Cl. ..... 91/497; 417/221

[58] Field of Search ..... 91/497; 417/221, 222, 417/218; 74/571 L

[56] References Cited

U.S. PATENT DOCUMENTS

| | | | |
|---|---|---|---|
| 3,255,707 | 6/1966 | Platt | 91/497 |
| 3,700,356 | 10/1972 | Kubik | 417/222 |
| 3,828,400 | 8/1974 | Mason | 91/497 |
| 3,908,517 | 9/1975 | Wenbourne | 91/497 |

*Primary Examiner*—William L. Freeh

*Attorney, Agent, or Firm*—Michael J. Striker

[57] ABSTRACT

A fluid-displacement radial piston machine, such as a hydraulic pump or motor, includes an eccentric member which is mounted on a shaft for displacement radially thereof to thereby change the eccentricity of a contact surface of the eccentric member which is engaged by sliding shoes of a plurality of working pistons. An arrangement for displacing the eccentric member includes a piston component which is connected to the eccentric member by two displacing portions and whose piston portion subdivides a compartment of the shaft into two actuating chambers into which pressurized fluid is selectively admitted through respective passages in the shaft and through a rotary transmission interposed between a source of the pressurized fluid and the shaft. One check valve is interposed in each of the passages and interrupts the communication of the respective actuating chamber with the rotary transmission when no pressurized fluid is admitted into any of the passages. A throttling gap may be provided in each of the passages and may be constituted by a control member received in a bore and acting on the respective check valve to open the same when the eccentric member is to be displaced.

16 Claims, 4 Drawing Figures

FLUID-DISPLACEMENT RADIAL PISTON MACHINE

BACKGROUND OF THE INVENTION

The present invention relates to a fluid-displacement machine in general, and more particularly to a radial piston machine, such as a hydraulic pump or motor.

There are already known different constructions of fluid-displacement radial piston machines, among them such in which the sliding shoes of the working pistons slide over the periphery of an eccentric ring which is mounted on a shaft and is displaceable radially of the shaft by means of a cylinder-and-piston arrangement which is mounted in the shaft. The shaft is then supported in a housing of the machine, and a pressurized medium is or can be admitted to the cylinder-and-piston arrangement through connecting passages in the shaft and through a rotary transmission which is interposed between the housing of the machine and the shaft.

In one conventional fluid-displacement radial piston machine of this type, the cylinder-and-piston arrangement includes two mutually independent cylinder-and-piston units which are both mounted in the shaft for displacement in the radial direction of the shaft and which are oppositely displaceable by a hydraulic medium. Each of the cylinder-and-piston units includes a displacing piston which is mounted in a separate compartment and has an outer end face which abuts the eccentric ring. The inner end face of one of the displacing pistons is permanently acted upon by the hydraulic medium. The hydraulic medium reaches the actuating chambers of the two separate compartments through connecting passages which are provided in the shaft, the connecting passages being connected to a pressure and to a relief conduit for the hydraulic medium via a rotary transmission interposed between the shaft and the machine housing and including sealing rings.

A pronounced disadvantage of this conventional radial piston machine resides in the fact that the displacing pistons can only be displaced toward and into their respective two end positions. It is impossible to obtain a stable intermediate position of the displacing pistons and of the eccentric ring of this radial piston machine in view of the permanent action of the hydraulic medium on one of the displacing pistons. Therefore, the utility of this conventional machine is quite limited and this machine can only be used in certain applications and cannot be varied at will. It is further disadvantageous that one of the displacing pistons is constantly under the full pressure of the hydraulic medium. This has the consequence that even the rotary transmission between the machine housing and the shaft is always subjected to the full pressure of the hydraulic medium during the operation of the machine. As a result of this, the leakage loss in the region of the rotary transmission is very high. In addition thereto, the sealing rings which are arranged at the region of the rotary transmission are permanently loaded by the pressurized hydraulic medium, which reflects itself in continuous frictional forces which, in turn, results in a considerable wear of the sealing rings, or the surfaces with which the sealing rings are in sliding contact, or both. Consequently, as a result of the friction on the one hand, and of the leakage on the other hand, the mechanical as well as the volumetric efficiency of the above-mentioned conventional fluid-displacement radial piston machine is substantially reduced.

SUMMARY OF THE INVENTION

Accordingly, it is a general object of the present invention to avoid the disadvantages of the prior art.

More particularly, it is an object of the present invention to provide a fluid-displacement radial piston machine which is not possessed of the disadvantages of the conventional machines of this type.

A particular object of the present invention is to so design the radial piston machine as to keep the leakage losses and the wear in the region of the rotary transmission to a minimum.

A further object of the present invention is to so construct the machine of the type here under consideration as to be able to maintain the eccentric member thereof in any intermediate position between the terminal positions thereof.

Yet another object of the present invention is to develop a fluid-displacement radial piston machine in which it is possible to precisely select and maintain the desired position of the eccentric member.

An additional object of the present invention is to devise a radial piston machine in which the pressurized fluid which is used for displacing the eccentric member need not be permanently supplied to the displacing cylinder-and-piston arrangement.

A concomitant object of the present invention is to provide a radial piston machine which is simple in construction, inexpensive to manufacture and to operate, and reliable nevertheless.

In pursuance of these objects and others which will become apparent hereafter, one feature of the present invention resides in a fluid-displacement radial piston machine which comprises, in combination, a support; a shaft mounted on the support for rotation about a rotary axis; an eccentric member having a contact surface extending about an eccentric axis; means for mounting the eccentric member on the shaft for parallel displacement of the eccentric axis radially of the rotary axis, including means defining a radially elongated compartment in the shaft and a piston component having a piston portion mounted for longitudinal displacement in the compartment and sealingly subdividing the same in two actuating chambers, and two displacing portions each extending through one of the actuating chambers and sealingly radially beyond the shaft and connecting the piston portion with the eccentric member; a plurality of working pistons each mounted in the support for reciprocation substantially radially of the rotary axis and having an engaging surface which engages the contact surface of the eccentric member; means for displacing the piston component, including means in the shaft for bounding two passages each communicating with one of the actuating chambers, a pressurized fluid source, and means for communicating the source with a selected one of the passages only for a time period required to displace the piston component into any selected position thereof relative to the shaft, including a rotary transmission interposed between the support and the shaft; and two check valves each interposed in one of the passages and operative for interrupting the communication of the respective actuating chamber with the rotary transmission to maintain the piston component in the selected position thereof outside of, and for establishing such communication during, the above-mentioned time period.

When the radial piston machine is constructed in the above-mentioned manner, it is now possible, in an advantageous way, not only to accurately determine the two terminal positions of the eccentric member but also to displace the eccentric member into and maintain the same in any positively defined intermediate position between the maximum and minimum eccentricity of the eccentric ring, even during the operation of the machine. In this connection, it is of a considerable importance that, in the radial piston machine of the present invention, the pressurized fluid need be supplied to one or the other end face of the piston portion or, in other words, into one or the other of the actuating chambers, only during the time period when the piston component, together with the eccentric member, is being actually displaced in order to change the eccentricity of the contact surface of the eccentric member. As a result of this, no leakage losses are encountered outside of the time period during which the piston components is being actually displaced. The check valves which are so arranged as to interrupt the communication of the respective actuating chamber with the rotary transmission outside of the above-mentioned time period, and to establish such communication during this time period, positively prevent the return flow of the fluid so that it is assured that the piston component and the eccentric member connected thereto will remain in the respectively selected intermediate or terminal position thereof for the entire duration of the subsequent operation of the machine, that is, until the position of the piston component and, consequently, of the eccentric member, is changed again.

The piston component may include a cylindrical rod, and then the piston portion may be an annular collar which is slid onto and rigidly and sealingly connected to the cylindrical rod. However, the entire piston component may also be made of one piece. The piston portion is sealed with respect to the wall bounding the compartment in the shaft, which is preferably of a cylindrical configuration, so that it is impossible for the fluid to seep from one into the other of the actuating chambers. The actuating chambers which adjoin the piston portions are also sealed with respect to the outwardly projecting displacing portions of the piston component. To achieve this sealing purpose, it is advantageous to utilize annular cylinder seals. The piston component is arranged with a small axial tolerance play within the eccentric member, but is movable in the circumferential as well as in the axial direction of the shaft with a relatively free play. The compartment for the piston component can consist of a radial bore in the shaft, and an annular insert can be affixed by locking rings at the end of the radial bore, being operative for limiting the extent of displacement of the piston portion. The annular insert as well as the bottom portion of the radial bore are provided with openings and annular cylinder seals for the two displacing portions of the piston component.

In order to render possible a slow and exact displacement of the eccentric member, a further feature of the present invention provides means for defining a throttling gap in each of the above-mentioned passages. These throttling gaps avoid a sudden displacement of the eccentric member and thus contribute to a protection of the remaining parts of the machine.

It is further of advantage that the check valves are arranged radially in the shaft. This renders it possible, for instance, to achieve a simple and easy-to-manufacture configuration of the bores which accommodate the check valves. In this connection, it is especially advantageous when the check valves are arranged substantially in that portion of the shaft which is surrounded by a bearing which mounts the shaft on the support or housing of the machine. As a result of this, there is obtained not only an advantageous structural configuration of the shaft and of the above-mentioned shaft portion, but also a correspondingly advantageous configuration of the support or machine housing, and the mutual association of the support with the shaft. A particular advantage resides in the fact that double fits, which are quite difficult to accurately provide, can be avoided in a relatively simple manner.

According to a further concept of the present invention, the radial piston machine further comprises means for opening the check valves for the above-mentioned time period, including means defining a control compartment in the shaft, a control piston displaceably received in the control compartment and subdividing the same in two control chambers, means for admitting the pressurized fluid into a selected one of the control chambers, and two control members each of which is displaceable by the control piston at least toward one of the check valves to displace the same toward an open position thereof. The control members can either be attached to the control piston, or may only be in an abutting relationship therewith. In any event, it is achieved that double fits with the drawbacks inherent thereto are avoided. The control piston can be acted by the pressurized fluid from each of its sides. The check valves advantageously include spherical valve bodies which are pressed by helical springs against corresponding seats. A particular advantage of this construction of the check valves is that they are simple in construction while avoiding leakage of the fluid past the respective check valve. The control piston need not have any special seal at its periphery with respect to the surface bounding the control compartment. However, the configuration and the position of the control piston render it possible to provide a leakage-preventing annular cylinder seal at the periphery of the control piston.

The check valves can be incorporated immediately in correspondingly stepped radial bores of the shaft. However, an advantageous embodiment of the present invention resides in the fact that at least one, but possibly both, of the check valves are accommodated in inserts which are sealingly affixed in a bore which transversely extends through the shaft. Under the latter circumstances, it is possible to provide the bore in a single machining operation as a stepless through bore, which is very advantageous from the manufacturing viewpoint, and the inserts can be introduced into and positionally fixed in this bore by means of locking rings, as completely pre-manufactured structural parts incorporating the check valves. In addition thereto, the maintenance of the check valve is simplified in this construction, inasmuch as these inserts or structural units are easily and simply assemblable with and disassemblable from the shaft. Furthermore, these units can be made fully symmetrical, which simplifies their manufacture and facilitates their mounting. Leakage past these inserts is avoided by means of annular cylinder seals which are provided at the periphery of the respective inserts.

Even though the throttling gaps could be arranged anywhere along the course of the respective passages, a particularly advantageous facet of the present invention resides in the fact that the throttling gaps are defined by parts of the check valve. Advantageously, the means which defines the control compartment bounds two bores each of which displaceably receives one of the control members, these two bores, the two control chambers, and the admitting means constituting parts of the passages. Under these circumstances, it is especially advantageous when the throttling gap is defined by the respective control member in the respective bore receiving the same. By properly selecting the dimensions of the control members, on the one hand, and their receiving bores, on the other hand, the annular throttling gaps defined between the same are insensitive to soiling and clogging even at a low flow-through volume and a small play.

The maximum and minimum terminal position of the eccentric member can be determined, in accordance with the present invention, by providing abutments in the above-mentioned actuating chambers. It is especially advantageous when these abutments are detachable and, in accordance with a preferred concept of the present invention, the abutments are discrete abutment members insertable into the actuating chambers.

The present invention further proposes to mount the eccentric member on the shaft between a radial flange of the shaft, at least one annular mounting element positionally adjustable along the rotary axis, and two parallel planar surfaces of the shaft which together confine the eccentric member for the radial displacement thereof. In this manner, the planar surfaces assure that the eccentric member will not be able to turn about the rotary axis relative to the shaft. As a result of this, the eccentric member is freely displaceable in the opposite displacement directions, that is, radially of the shaft, but is movable in the axial and circumferential direction of the shaft only within the framework of the necessary tolerance play. Possible wear manifestations can be compensated for by readjustment or exchange of the positionally adjustable mounting element.

One advantageous aspect of the present invention resides in the fact that the two end faces of the piston portion of the piston component which respectively face the actuating chambers have the same area. However, it is also contemplated by the present invention to give the two end faces of the piston portion of the piston component different areas. In this event, it is advantageous when the end face with the greater area is subjected to the influence of the pressurized fluid when the eccentricity of the eccentric member is to be reduced.

The danger of jamming in the region of the rotary transmission and the possibility of scoring and seizing are avoided in the framework of the present invention in that the shaft portion of the shaft which is received in the support is spaced a considerable distance from the support. Advantageously, the rotary transmission includes gas-impermeable metallic sealing rings which axially define communicating channels in the spacing between the shaft and the support, the individual channels separately communicating the connecting passages in the shaft with corresponding ducts in the support. The relatively huge play is now rendered possible by the fact that the rotary transmission is under the influence of the pressurized fluid only for the time period during which the eccentric member is being actually displaced. Inasmuch as this time period is very short under most circumstances, the somewhat higher leakage which occurs during the rather limited time period, is quite acceptable. After the termination of the displacing operation, the rotary transmission immediately becomes depressurized so that, as a result of this, no leakage can occur any longer. What is further achieved by this feature is that it is no longer necessary to provide oil-guiding grooves in the shaft. On top of this, double fits are no longer necessary.

The pressurized fluid, such as a hydraulic fluid, is admitted to the piston component, in accordance with the invention, through admitting conduits for the fluid which have interposed therein a closing valve. Advantageously, the closing valve is a three-position four-port valve. By providing this closing valve, it is assured that the rotary transmission is always depressurized after the termination of the displacing operation, and thus becomes leak-proof and frictionless. The respective position of the piston component is, however, maintained by the check valves for so long until the piston component is again displaced into a new position following an actuation of the closing valve.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENTS

Figure 1:
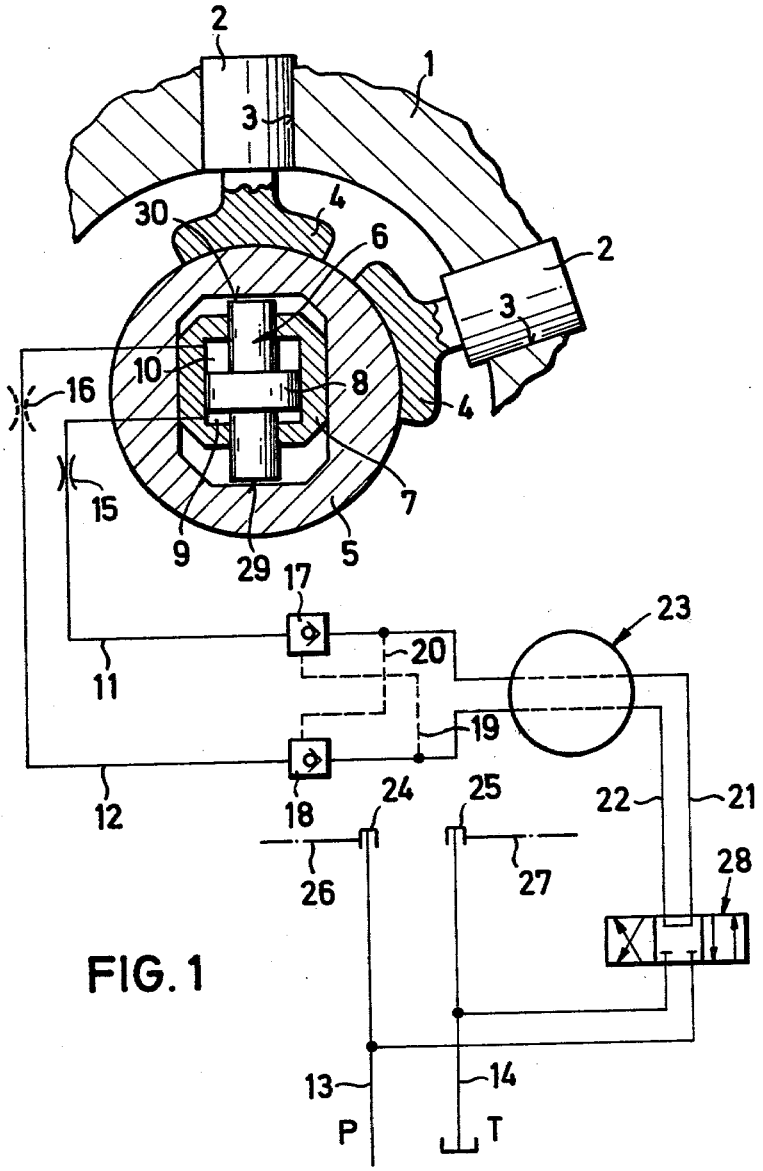
FIG. 1 is a somewhat diagrammatic representation of the displacing portion of the radial piston machine of the present invention.

Referring now to the drawing in detail, and first to FIG. 1 thereof, it may be seen that the reference numeral 1 has been used to designate, in toto, a housing or support of a fluid-displacement radial piston machine, for instance, of a radial piston motor. In the support, there are mounted working pistons 2 for reciprocation, in a star-shaped distribution, in correspondingly configurated cylinders 3 which extend substantially radially. The working pistons 2 have piston shoes 4 which are in sliding contact with the outer periphery of an eccentric member 5. The eccentric member 5 is mounted on a shaft 7 for radial displacement relative to the rotary axis of the shaft. A piston component 6 accomplishes the displacement of the eccentric member 5 relative to the shaft 7 and thus determines the extent of reciprocation of the working pistons 2.

The piston component 6 has, in its central longitudinal region, an annular collar 8. Two actuating chambers 9 and 10 adjoin the annular collar 8 at both sides thereof, the actuating chamber 9 and 10 being respectively connected by connecting passages 11 and 12 with the pressure and relief ducts 13 and 14 for a fluid, such as a hydraulic fluid, particularly oil. The connecting passages 11 and 12 are provided in the shaft 7 and are equipped with throttling gaps 15 and 16, as well as with check valves 17 and 18 which are so arranged and actuated as to open and close in dependence on the pressure prevailing in the respective other of the connecting passages 11 and 12. The corresponding control conduits are indicated with the reference numerals 19 and 20.

The transmission of the pressurized fluid between the connecting passages 11 and 12 in the shaft 7 and the ducts 21 and 22 in the support or housing 1 is achieved by a rotary transmission 23. The commutation of the hydraulic working medium is only indicated in a diagrammatic fashion by connectors 24 and 25 and by connecting conduits 26 and 27. Thus, ensued the admission of the fluid into and expulsion from the working cylinders 3. A three-position four-port valve 28 is incorporated in the ducts 21 and 22 between the pressure and relief conduits 13 or 14 and the rotary transmission 23, the valve 28 being controllable as to its position either manually or by remote control.

When the three-position four-port valve 28 is moved into its leftward terminal position, the pressurized fluid flows through the duct 21, the rotary transmission 23, the check valve 17 and the throttling gap 15 into the actuating chamber 9 for so long as the three-position four-port valve 28 remains in its left terminal position. As a result of this, the piston component 6 is displaced relative to the shaft 7 and, as a result of the contact of two end faces 29 or 30 of the piston component 6 inwardly on the eccentric member 5, the latter is correspondingly displaced eccentrically with respect to the rotary axis of the shaft 7. Simultaneously therewith, the fluid present in the actuating chamber 10 flows through the connecting passage 12, the check valve 18 which is in its open position because of the action of the fluid present in the control conduit 20, through the rotary transmission 23, the duct 22 and the three-position four-port valve 28 into the relief conduit 14.

Now, when the three-position four-port valve 28 is moved, after the termination of the displacing operation, again into the illustrated closing position, the ducts 21 and 22, or the passages 11 and 12 between the three-position four-port valve 28 and the actuating chambers 9 or 10, become depressurized and, because of the presence of the check valves 17 and 18, which assume their closed positions, the fluid present in the actuating chambers 9 and 10 and in the adjoining sections of the passages 11 and 12 is prevented from flowing out. Thus, the piston component 6 remains in its adjusted precisely defined position.

When the three-position four-port valve 28 is transferred into its right hand terminal position, the pressurized fluid flows from the conduit 13 via the duct 22, the rotary transmission 23, the check valve 18 and the throttling gap 16 into the actuating chamber 10 and there displaces the piston component 6 for so long in the opposite direction as the three-position four-port valve 28 is open. The fluid from the actuating chamber 9 flows through the passage 11, the check valve 17 which is held open by the action of the fluid present in the control conduit 19, through the rotary transmission 23, the duct 21 and the three-position four-port valve 28 to the relief conduit 14.

After the three-position four-port valve 28 is transferred from its right terminal position again into the illustrated closing position, the passages 11 and 12 and the ducts 21 and 22 between the three-position four-port valve 28 and the check valves 17 and 18 again become depressurized and the piston component 6 remains in the then assumed position thereof, inasmuch as the check valves 17 and 18, which assume their closed positions, prevent the flow of the fluid out of the actuating chambers 9 and 10 and the sections of the passages 11 and 12 which extend between the actuating chambers 9 and 10 and the check valves 17 and 18.

Figure 2:
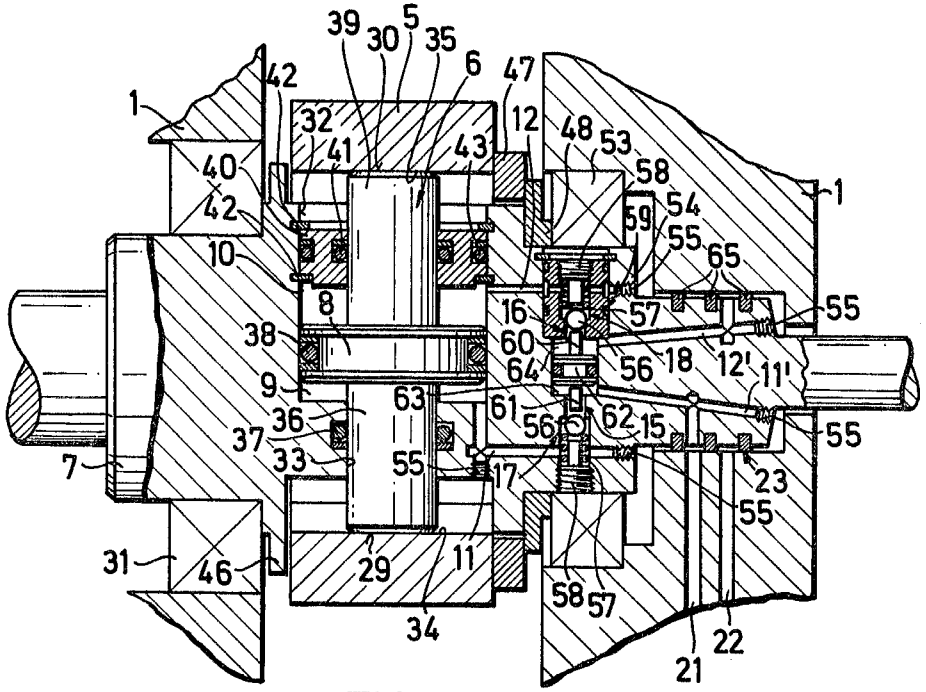
FIG. 2 is a longitudinal sectional view of one embodiment of the displacing arrangement for the eccentric member.
Figure 3:
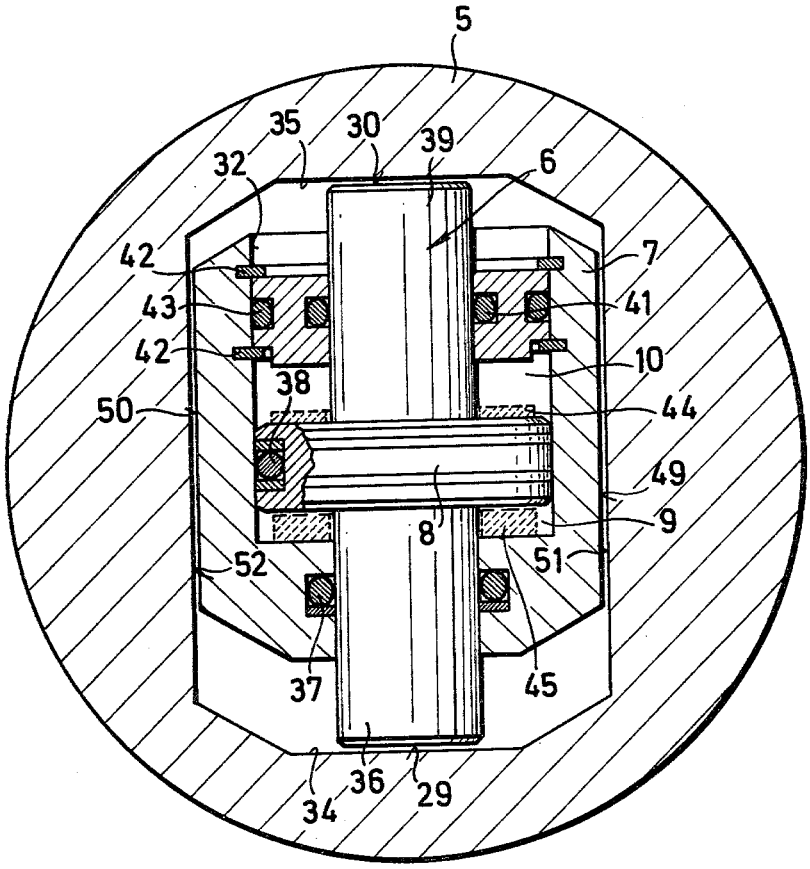
FIG. 3 is a cross-sectional view taken on line III—III of FIG. 2.

According to the embodiment of the present invention which is illustrated in detail in FIGS. 2 and 3, the shaft 7 is supported in the support or housing 1 of the machine by an anti-friction bearing 31, and has a cylindrical radial bore 32 of a greater diameter, and a further bore 33 of a smaller diameter. These radial bores 32 and 33 receive the cylindrical piston component 6 for displacement of the latter in the longitudinal direction of the bores 32 and 33. The piston component 6 has end faces 29 and 30 which abut, with a small play, the inner sides 34 and 35 of the eccentric member 5. The diameter of the piston component 6 corresponds to that of the radial bore 33 having the smaller diameter. The sealing between a displacing portion 36 of the piston component 6 which passes through the smaller-diameter bore 33 and the shaft 7 is obtained by means of an annular cylinder seal 37 in the shaft 7.

An annular collar 8 is provided in the central longitudinal region of the piston component 6. The annular collar 8 is sealed, at its circumference, by means of an annular cylinder seal 38, with respect to the larger-diameter radial bore 32. A displacing portion 39 of the piston component 6 is sealingly guided in an annular insert 40. This sealing action is achieved by means of an annular cylinder seal 41 in the annular insert 40. The annular insert 40 is affixed in the bore 32 by locking rings 42, and is sealed with respect to the bore 32 by an annular cylinder seal 43.

As indicated in FIG. 3, the terminal positions of the piston component 6 can be varied by abutment discs 44 and/or 45 which may be exchangeable and which may be of different thicknesses.

The radial guidance of the eccentric member 5 is achieved, on the one hand, by a radial flange 46 of the shaft 7, as well as by positionally adjustable mounting elements or discs 47 and 48 and, on the other hand, by mutually parallel planar surfaces 49 and 50 of the shaft 7 and the corresponding planar surfaces 51 and 52 of the eccentric member 5. The mounting discs 47 and 48 abut a bearing 53 which surrounds a shaft portion 54 of the shaft 6 and supports the same in the housing 1.

The above-mentioned connecting passages 11, 12 communicate with the actuating chambers 9 and 10 which are respectively located at the two sides of the annular collar 8 of the piston component 6. The check valves 17 and 18 are incorporated, respectively, in the connecting passages 11 and 12. The unused end portions of the connecting passages 11 and 12 are sealingly closed by plugs 55. The check valves 17 and 18, which consist of spherical valve bodies 56 and of helical compression springs 57 which rest against respective threaded blocks 58, which are received in stepped radial bores of the shaft 7, and of which the check valve 18 is incorporated in an insert body 59 while the other check valve 17 is immediately received in the stepped bore of the shaft 7, can be opened by control members 60 and 61 which are connected with a control piston 62 that is located centrally in the shaft 7. In the illustrated exemplary embodiment of the present invention, the control member 60 is rigidly connected to the control piston 62, while the other control member 61 only abuts the control piston 62. The control members 60 and 61 are received with a substantial play in the respective bores of either the shaft portion 54 or the insert body 59, so that the throttling gaps 15 and 16 are defined between the outer periphery of the respective control member 60 or 61 and the surface which bounds the bore in which the respective control member 60 or 61 is received.

The control piston 62 separates two control chambers 63 and 64 from one another. Connecting passage sections 11' or 12' which are provided in the shaft portion 54 of the shaft 7 respectively communicate with the control chambers 63 and 64. The connecting passage 11' communicates, in the region of the rotary transmission 23, with the duct 21, while the connecting passage 12' is similarly in communication with the duct 22. The transmission between the passage 11' and the duct 21, on the one hand and between the passage 12' and the duct 22, on the other hand, are separated from one another and from the environment by hermetically sealing metallic sealing rings 65. It can be further ascertained from the drawing that the shaft portion 54 is received in the machine housing 1 with a substantial play.

Figure 4:
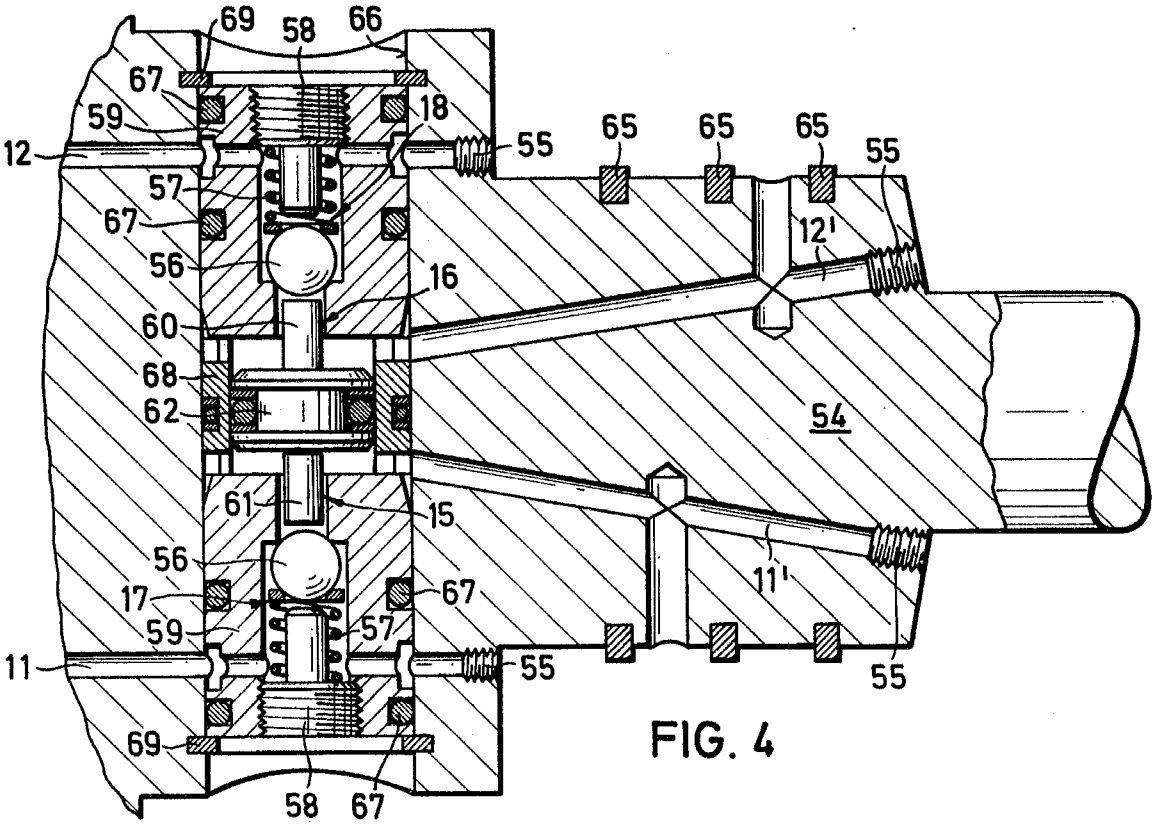
FIG. 4 is a view similar to FIG. 2 but of a modified embodiment of the displacing arrangement of the present invention.

In the modification illustrated in FIG. 4, at an enlarged scale, both of the check valves 17 and 18 are incorporated in respective insert bodies 59, the insert bodies 59 being accommodated in a stepless through transverse bore 66 in the shaft portion 54 of the shaft 7. Each of the insert bodies 59 is sealed by annular cylinder seals 67 with respect to the transverse bore 66. The two insert bodies 59 support each other by means of an insert ring 68 which guides the control piston 62 at its interior. At their outer peripheries, the insert bodies 59 are affixed in the transverse bore 66 by respective locking rings 69. The remainder of the configuration of the shaft portion 54 of the shaft 7, as well as the configuration and operation of the parts located at the region of the eccentric member 5 and of the piston component 6, correspond to those illustrated in and discussed in connection with FIGS. 2 and 3.

It will be understood that each of the elements described above, or two or more together, may also find a useful application in other types of constructions differing from the types described above.

While the invention has been illustrated and described as embodied in a fluid-displacement radial piston machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fluid displacement radial piston machine comprising, in combination, a support; a shaft mounted on said support for rotation about a rotary axis; an eccentric member having a contact surface extending about an eccentric axis; means for mounting said eccentric member on said shaft for parallel displacement of said eccentric axis radially of said rotary axis, including means defining a radially elongated compartment in said shaft and a piston component having a piston portion mounted for longitudinal displacement in said compartment and sealingly subdividing the same in two actuating chambers, and two displacing portions each extending through one of said actuating chambers and sealingly radially beyond said shaft and connecting said piston portion with said eccentric member; a plurality of working pistons each mounted in said support for reciprocation substantially radially of said rotary axis and having each an engaging surface which engages said contact surface of said eccentric member; means for displacing said piston component, including means in said shaft for bounding two passages each communicating with one of said actuating chambers, a pressurized fluid source, and means for communicating said source with a selected one of said passages only for a time period required to displace the piston component into any selected position thereof relative to said shaft, including a rotary transmission interposed between said support and said shaft; and two check valves each interposed in one of said passages, arranged so as to open and close in dependence on the pressure prevailing in the other of said passages, and operative for interrupting the communication of the respective actuating chamber with said rotary transmission to maintain said piston component in said selected position thereof outside of, and for establishing such communication during, said time period.

2. A combination as defined in claim 1, wherein said check valves are arranged radially of said shaft.

3. A combination as defined in claim 1; further comprising means for mounting said shaft on said support, including a bearing which surrounds a portion of said shaft; and wherein said check valves are arranged substantially in said portion of said shaft.

4. A combination as defined in claim 1, wherein said shaft has a bore; and further comprising means for supporting said check valves in said bore, including at least one insert immovably and sealingly received in said bore.

5. A combination as defined in claim 1, wherein said means for mounting said eccentric member on said shaft includes a radial flange of said shaft, at least one annular mounting element positionally adjustable along said rotary axis, and two parallel planar surfaces of said shaft which together confine said eccentric member for said radial displacement thereof.

6. A combination as defined in claim 1, wherein said piston portion of said piston component has two end faces which respectively face said actuating chambers and which have the same area.

7. A combination as defined in claim 1, wherein said piston portion of said piston component has two end faces which respectively face said actuating chambers and which have different areas.

8. A combination as defined in claim 1, wherein said shaft has a shaft portion which is received in said support with a considerable spacing therefrom.

9. A combination as defined in claim 1; and further comprising means for defining a throttling gap in each of said passages.

10. A combination as defined in claim 9; wherein said means defining said throttling gap includes parts of said check valves.

11. A combination as defined in claim 1; and further comprising means for opening said check valves for said time period, including means defining a control compartment in said shaft, a control piston displaceably received in said control compartment and subdividing the same in two control chambers, means for admitting the pressurized fluid into a selected one of said control chambers, and two control members each of which is displaceable by said control piston at least toward one of said check valves to displace the same toward an open position thereof.

12. A combination as defined in claim 11, wherein said means for defining said control compartment bounds two bores each of which displaceably receives one of said control members; wherein each of said two bores, each of said two control chambers, and said admitting means constitute parts of one of said passages; and wherein the respective control member defines in the respective bore receiving the same a throttling gap.

13. A combination as defined in claim 1; and further comprising abutments in said actuating chambers.

14. A combination as defined in claim 13, wherein said abutments are discrete abutment members insertable into said actuating chambers.

15. A combination as defined in claim 1; and wherein said communicating means includes a closing valve interposed between said source and said rotary transmission.

16. A combination as defined in claim 15, wherein said closing valve is a three-position four-port valve.

* * * * *